US008259981B2

(12) United States Patent
Danley

(10) Patent No.: US 8,259,981 B2
(45) Date of Patent: Sep. 4, 2012

(54) HORN-LOADED ACOUSTIC LINE SOURCE

(76) Inventor: Thomas J. Danley, Highland Park, IL (US)

( * ) Notice: Subject to any disclaimer, the term of this patent is extended or adjusted under 35 U.S.C. 154(b) by 379 days.

(21) Appl. No.: 12/456,569

(22) Filed: Jun. 18, 2009

(65) Prior Publication Data

US 2009/0323997 A1 Dec. 31, 2009

Related U.S. Application Data

(60) Provisional application No. 61/132,394, filed on Jun. 18, 2008.

(51) Int. Cl.
*H04R 25/00* (2006.01)

(52) U.S. Cl. ..... 381/337; 381/340; 381/345

(58) Field of Classification Search ..... 381/337, 381/339, 340, 341, 342, 343, 160, 182, 186, 381/345, 347, 352; 181/144, 152, 159, 177, 181/187, 192, 193, 194
See application file for complete search history.

(56) References Cited

U.S. PATENT DOCUMENTS 2,638,510 A * 5/1953 Brami ..... 381/341
4,344,504 A * 8/1982 Howze ..... 181/187
6,411,718 B1 * 6/2002 Danley et al. ..... 381/342

* cited by examiner

*Primary Examiner* — Huyen D Le
(74) *Attorney, Agent, or Firm* — Olson & Cepuritis, Ltd.

(57) ABSTRACT

A sound reproduction system is disclosed in which a sound enclosure defines a soundwave path having a first end, a second open end and at least one bend therebetween. At least one driver is provided at the first end for producing a driver soundwave that is confined by the sound enclosure for travel along the soundwave path. At least one baffle member is situated in the soundwave path, defining a reflective surface of preselected shape that reflects and constricts the soundwave therethrough.

3 Claims, 9 Drawing Sheets

HORN-LOADED ACOUSTIC LINE SOURCE

CROSS-REFERENCE TO RELATED APPLICATIONS

This application claims the benefit of U.S. Provisional Application No. 61/132,394, filed Jun. 18, 2008, which is incorporated herein by reference.

FIELD OF THE INVENTION

The present invention relates to sound reproduction systems in which one or more drivers, mutually coupled to a sound enclosure, have their combined three-dimensional waveshape altered within the enclosure to a preselected exit waveshape.

DESCRIPTION OF THE RELATED ART

Originally, the art of horn loading of drivers was done to increase the electroacoustic efficiency of the drivers. Various techniques were employed early on to make the most of limited amplifier power and relatively low power handling capabilities of available drivers. Early efforts were centered around obtaining the greatest sound level possible. Horn loaded speakers, sometimes referred to simply as "horns" or "warning systems" of this early era were generally designed to have a specific expansion rate throughout, and typically were made to have a defined shape such as that of a simple cone as well as curved wall flares having shapes corresponding to exponential or hyperbolic curves. Typically, these designs were aimed at giving the best low-frequency performance.

Complementary horn/driver systems were developed for different frequency ranges to optimize the ability of a horn to confine the sound wave in a practical manner. The design of relatively low frequency horns encountered challenging problems because of the mass and acoustic size required, and because the ability of a horn to confine the sound to a given angle diminishes below some frequency defined by the wavelength being produced for horns having a practical wall angle and dimension. For practical horns, a frequency inevitably arises where, due to practical dimensional considerations, the horn loses the ability to control the radiation angle of the soundwave being guided by the enclosure.

As noted above, one practical challenge faced by loudspeaker systems of all types is the ability to deliver a minimum desired sound pressure level to the listener's environment. Over the years, certain fundamental types of loudspeaker systems have been recognized for their inherent ability to deliver sound pressure levels. The two most popular types are those employing point source drivers (cones, domes, horns, multicellular panels, etc.). and line source drivers (e.g. ribbon drivers and elongated planar drivers). With point source drivers, sound is conceptualized as emanating from a single point, expanding in all directions, i.e. "spherically" (e.g. vertically, floor to ceiling and horizontally, side to side).

In contrast, a line source radiates sound in a cylindrical pattern. Sound travels outward from the driver in the shape of an expanding cylinder, bounded at its ends by flat, planar end planes, and not as an expanding sphere, as in the case of point sources. This confined soundwave pattern of a line source is inherently more efficient than that of a point source, since the expanding spherical sound energy of a point source is confined into the shape of an expanding cylinder, so as to "focus" or concentrate the same energy into a spatial region of reduced size. Theoretically, line source systems are twice as efficient as point source systems.

Line sources may be characterized as a type of acoustic source which is acoustically large in one dimension (their length) but acoustically small in the other direction (cross-sectional dimension). Attempts have been made, for example, to emulate a line source by a linear arrangement of discrete line sources. Despite some interesting results, improved systems are still being sought. One problem with such arrangements, for example, is the undesirable interaction of one point source with another that inevitably arises due to propagation effects arising in a practical system.

Accordingly, non-line source sound reproduction systems which truly appear to be that of a line source is still being sought. Further, sound reproduction systems that allow convenient shaping of their exiting wavefront are also being sought.

SUMMARY OF THE INVENTION

The present invention provides a novel and improved sound reproduction system in which a sound enclosure defines a soundwave path having a first end, a second open end and at least one bend therebetween At least one driver is provided at the first end for producing a driver soundwave that is confined by the sound enclosure for travel along the soundwave path. At least one baffle member is situated in the soundwave path, defining a reflective surface of preselected shape that reflects and constricts the soundwave therethrough.

In a first example of a sound reproduction system according to principles of the present invention, the sound enclosure comprises a horn that presents an acoustic load to the driver and the bend is located at or near the reflective surface.

In a second example of a sound reproduction system according to principles of the present invention, the slotted passageway is formed as a slot that is cut out from a sheet of sound baffle material disposed within the passageway.

In a third example of a sound reproduction system according to principles of the present invention, a planar wave output is provided, with an internal baffle with a correction slot introducing a spatially distributed time delay correction, matched to the driver output, to "flatten out" the shape of the exit soundwave. The internal correction slot provides three-dimensional wave shaping of the driver soundwave as it travels through the enclosure.

In a further example of a sound reproduction system according to principles of the present invention, the sound enclosure comprises a horn that loads a point source driver so as to produce an exit soundwave that truly resembles that output from a line source.

DESCRIPTION OF THE PREFERRED EMBODIMENTS

Figure 3:
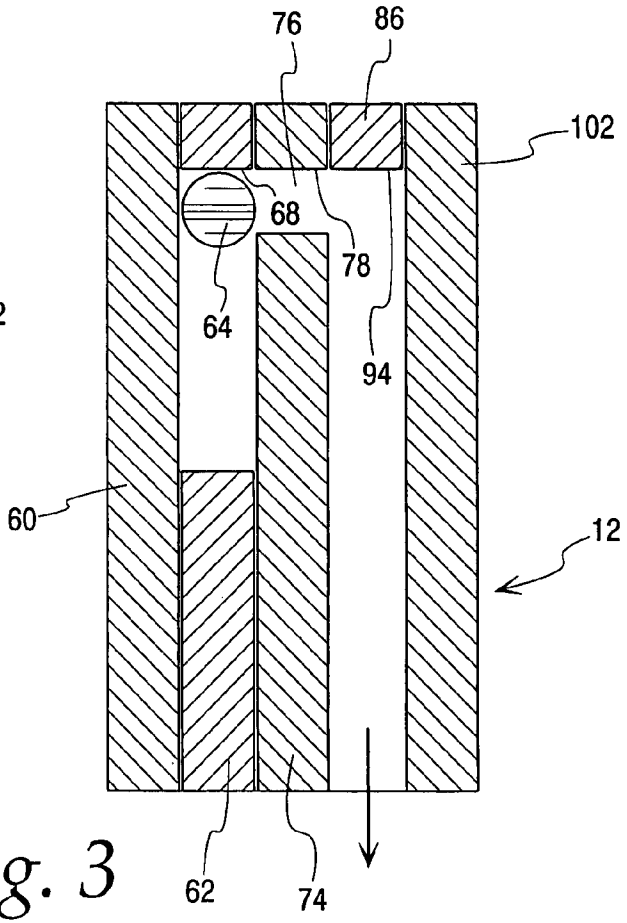
FIG. 3 is a diagrammatic cross-sectional view of the first embodiment of a sound reproduction system, taken along line 3-3 of FIG. 1, and shown exaggerated for purposes of illustration.

The invention disclosed herein is, of course, susceptible of embodiment in many different forms. Shown in the drawings and described herein below in detail are the preferred embodiments of the invention. It is to be understood, however, that the present disclosure is an exemplification of the principles of the invention and does not limit the invention to the illustrated embodiments.

For ease of description, sound reproduction systems embodying the present invention are described herein below in their usual assembled position as shown in the accompanying drawings and terms such as front, rear, upper, lower, horizontal, longitudinal, etc., may be used herein with reference to this usual position. However, the sound reproduction systems may be manufactured, transported, sold, or used in orientations other than that described and shown herein.

Figure 1:
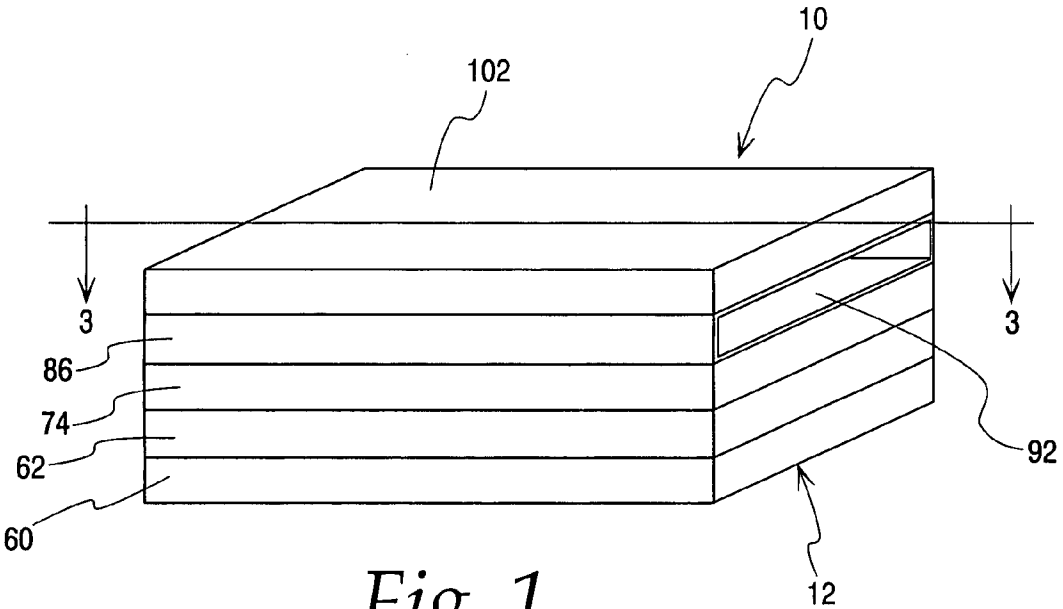
FIG. 1 is a diagrammatic perspective view of a first embodiment of a sound reproduction system illustrating certain aspects of the present invention.

Referring now to FIG. 1, a sound reproduction system embodying certain aspects of the present invention is generally indicated at 10. Included is an enclosure generally indicated at 12 to provide acoustic loading for the output of a driver 14 (see FIG. 2*b*). In the preferred embodiment, enclosure 12 is constructed by joining a stack of layers together. Included are outer layers 60, 102 and a middle layer or baffle plate 74. A horn input layer 62 is disposed between baffle plate 74 and outer layer 60, and a horn exit layer 86 is located between baffle plate 74 and outer plate 102. The horn input layer 62 and horn exit layer 86 cooperate with neighboring layers to form chambers at the inlet and exit portions of the enclosure. The layer construction will be described below, with reference to FIGS. 21*a*-2*e* and FIG. 3.

Enclosure 12 preferably comprises a horn that defines a pathway for the soundwave emanating from driver 14. As will be seen herein, the pathway defined by the horn enclosure includes a number of features including a bend in the soundwave path, an internal baffle with a reflective surface of defined curvature, a flow restriction located adjacent, and most preferably, coincident with the reflective surface, and an expansion chamber downstream of the construction and/or the reflective surface.

Figure 13:
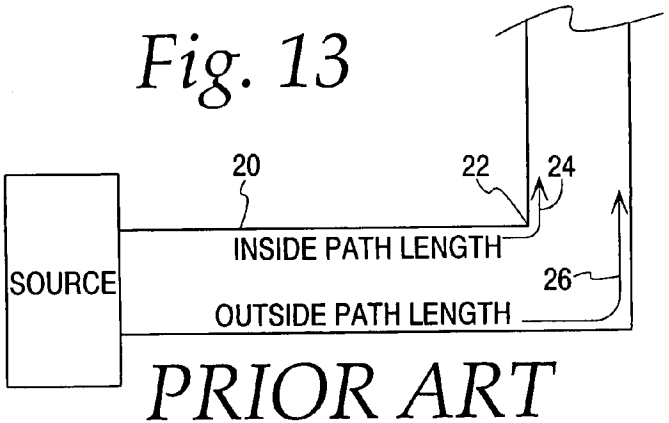
Fig. 13 PRIOR ART
FIG. 13 is a diagrammatic cross-sectional view of a prior art duct with a right angle bend.

The enclosure of the preferred embodiment forces the soundwave to bend as it travels toward the enclosure exit. In bending around a corner, there must be a specific relationship between the duct dimension, the wavelength of the highest frequency of concern and the angle of bend. FIG. 13 shows an imaginary duct 20 where the sound must bend around a corner 22. Notice that the inner path length 24 and outer path length 26 are different. To pass sound without problems the difference between the inside and outside path length must be kept to less than one-third wavelength at the highest frequency of interest. Above this frequency, the mixing of energy greater than about ⅓ wavelength apart in passage results in periodic cancellation and acts like a resonant acoustic low pass filter.

The present invention, in one aspect, finds application in the field of line sources. Line sources are a type of acoustic source which is acoustically large in one dimension but acoustically small in the other. An elongated ribbon driver is an example of this type of arrangement. Ribbon sources radiate in an expanding cylindrical pattern, with a planar wave in the vertical and wide in the horizontal. Here, the sound is produced across its entire height, over the entire frequency range simultaneously and as a result of the large acoustic source size, large enough to produce directivity. This radiates more like a cylindrical shape wave as opposed to a spherical wavefront. In the line source case, the sound pressure falls off more slowly with distance, (ideally, if the source were infinitely long), at half the rate compared to a point source, where the sound travels away in a spherical pattern. For the point source, the energy density at a given distance (at the surface of the expanding sphere) is found to fall at the inverse square law, the sound pressure level falls 6 dB or a factor of four in power for each doubling of the distance.

Figure 14:
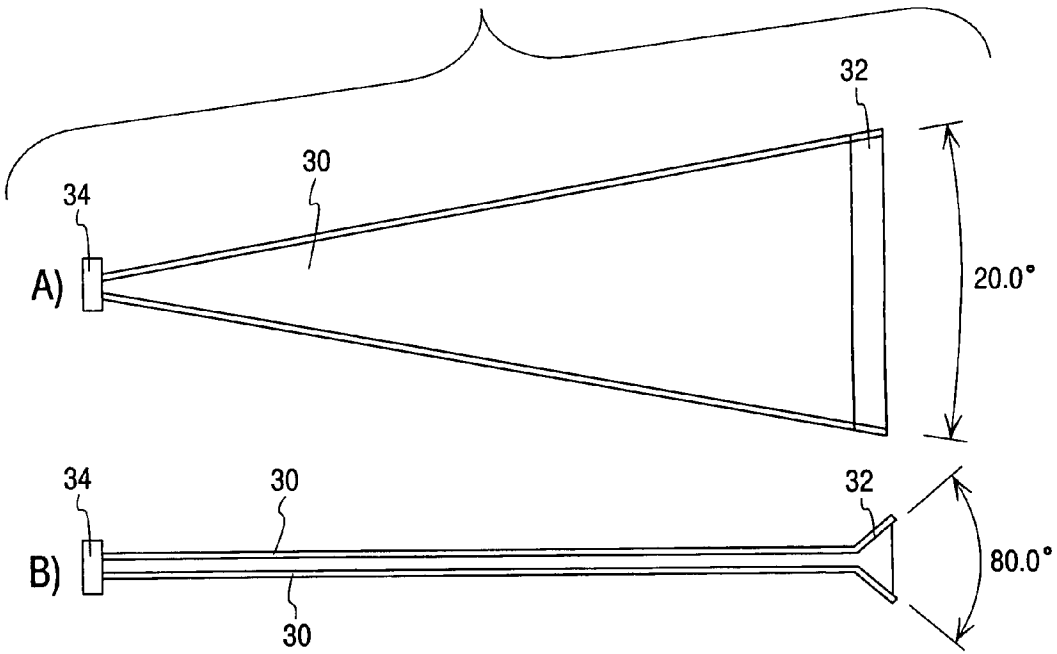
Fig. 14 PRIOR ART
FIGS. 14*a*, 14*b* are diagrammatic cross-sectional views of a prior art sound reproduction system.

A prior art attempt to utilize a horn to approximate a line source using a point source driver is shown in FIG. 14. As seen in the side elevation view of FIG. 14(*a*), the enclosure sidewall 30 takes the form of a 20 degree two-dimensional conical section with a continuous 20 degree mouth 32. Thus, the soundwave emanating from point source driver 34 is continuously expanded in the vertical direction. The enclosure 30, does not form a three dimensional cone, however. The top plan view of FIG. 14(*b*) shows that the sidewalls 30 are flat, parallel and spaced-apart from one another, so as to provide a constant confinement for the soundwave emanating from driver 34 as it travels toward mouth 32. As indicated in FIG. 14, the mouth 32 conforms to an 80 degree horizontal pattern, compared to the 20 degree vertical pattern shown in FIG. 14(*a*). Unfortunately, the enclosure 30 does not address the need to control the shape of the wavefront emanating from mouth 32. From a geometric perspective, the horn enclosure 30 suggests a line source but does not radiate a plane or flat wave in the vertical plane. Instead, the spherically expanding point source radiation has an arc related to the radius taken from the point source.

Not recognized in the design of FIG. 14, are the advantages of producing a wave front with little or no curvature (at most, only a few degrees) to perform like an actual line source. Any meaningful re-design of the horn enclosure of FIG. 14 would require the depth to be so large as to be impractical. If multiple enclosures 30 were stacked one on top of the other, the design must accommodate wavelengths where the horn is large enough to have directivity and so project output conforming to the horn wall angle. In front of the two horns there is an expanding field where the radiations overlap and cause self-interference. While most commercial line arrays have this effect over some or a large part of there range, it is not desirable.

The design configuration shown in FIG. 1 introduces a particular loading on driver 14, such that the driver 14 can be realized as a point source utilizing a cone diaphragm, for example, but still produce output with a substantially flat, planar wavefront. The enclosure design indicated in FIG. 1 is, in one embodiment, realized in a horn enclosure that allows one to assign either a predefined exit wavefront curvature or an absence of exit curvature to output from the enclosure, by adjusting the shape of a reflective surface at a point of bending and flow constriction, followed by controlled flow expansion.

In one embodiment, the shape and flow constriction is provided by an internal baffle plate with a correction slot that forces the soundwave traveling along the enclosure, through an expanding passage sized with acoustic dimensions that are small enough so that the sound can bend around corners without interference. In one example, sound reproduction systems according to principles of the present invention can be employed as one stage in a multi-stage configuration, producing a wavefront shape that is suitable, or optimized for following stages, such as a downstream horn section, for example.

Figure 15:
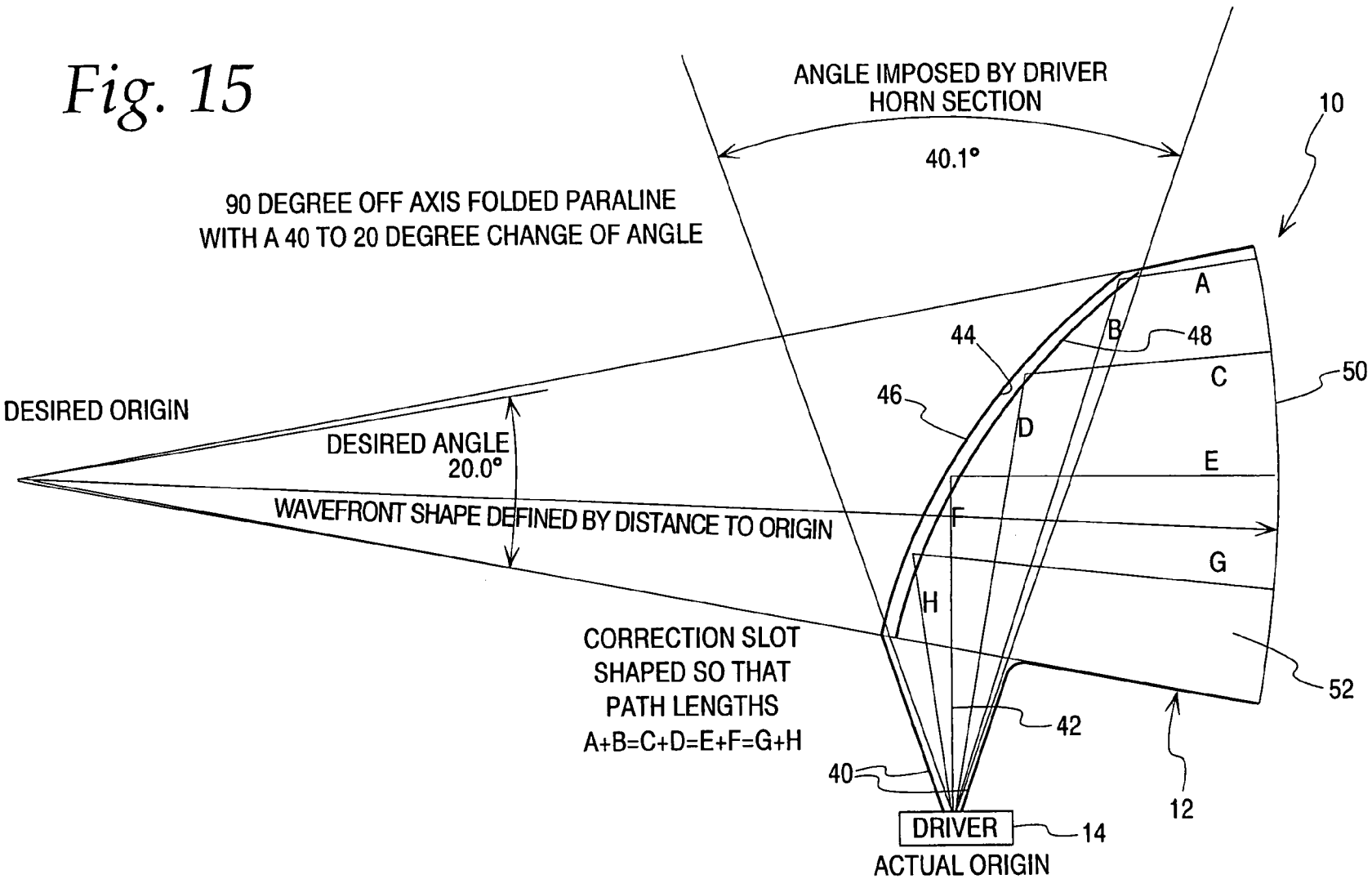
FIG. 15 is a diagrammatic illustration of design principles and relative component locations for a sound reproduction system illustrating certain aspects of the present invention.

FIG. 15 shows a diagrammatic illustration of design principles and relative locations of system components for a first embodiment of the present invention. Included in the enclosure 12 of system 10 is an input opening 40 that provides entry for a soundwave emanating from driver 14 into an input chamber 42. In the preferred embodiment, driver 14 comprises a conventional point source driver, such as one having a cone diaphragm. The soundwave from driver 14 is received in input chamber 42 that acts as an expansion chamber. The soundwave is then forced through a baffle plate with a slotted opening 44 that confines the soundwave to a flow constriction, given the relatively small size of the elongated, thin slotted opening 44. The slotted opening 44 is formed by a rear wall 46 and a front wall 48. The rear wall is formed to have a continuous, defined curvature, such that path lengths of the soundwave traveling through the enclosure 12 are nearly identical, thus defining a flat exit wavefront at the mouth or exit 50 of the enclosure. The correction slot may therefore be seen to function as a corrective time delay element that shapes the exit wavefront as desired.

After traveling through the slotted opening 44, the soundwave enters an exit chamber 52 whose walls conform to the desired 20 degree angle. The exit chamber 52 operates as an expansion chamber for the soundwave leaving the slotted opening 44. In the example illustrated, the driver 14 imposes an angle of 40.1 degrees on input chamber 42. The slotted opening 44, and more particularly its rear or back reflective wall 46 has a curvature such that all components of the soundwave confined by the enclosure 12 have equal path lengths. Several exemplary paths are shown in FIG. 15. The paths are divided into two parts, one prior to reflection against the surface of rear wall 46, the other after reflection. For example, a first, uppermost path is comprised of path segments A and B. An adjacent path is comprised of path segments C and D. Two more paths are shown, one comprising path segments E and F, and the other comprising path segments G and H. According to one principle of the present invention, the curvature of slotted opening and/or reflective surface 46 is chosen such that all of the paths have substantially the same length from the input to the output of the enclosure.

Design configurations according to principles of the present invention adjust the path length (in time or space) of a soundwave traveling through the enclosure, so that the sound pressure from the particular driver employed is constrained to follow a predefined pattern. For example, when a planar wavefront is desired, all portions of sound pressure from the driver are constrained to follow an identical time or space path length to any point at the exit slot. In one aspect, this is accomplished with an expanding cross section horn whose dimension in one plane is small enough to be folded with little or no loss up to the highest frequency of concern.

Figure 2:
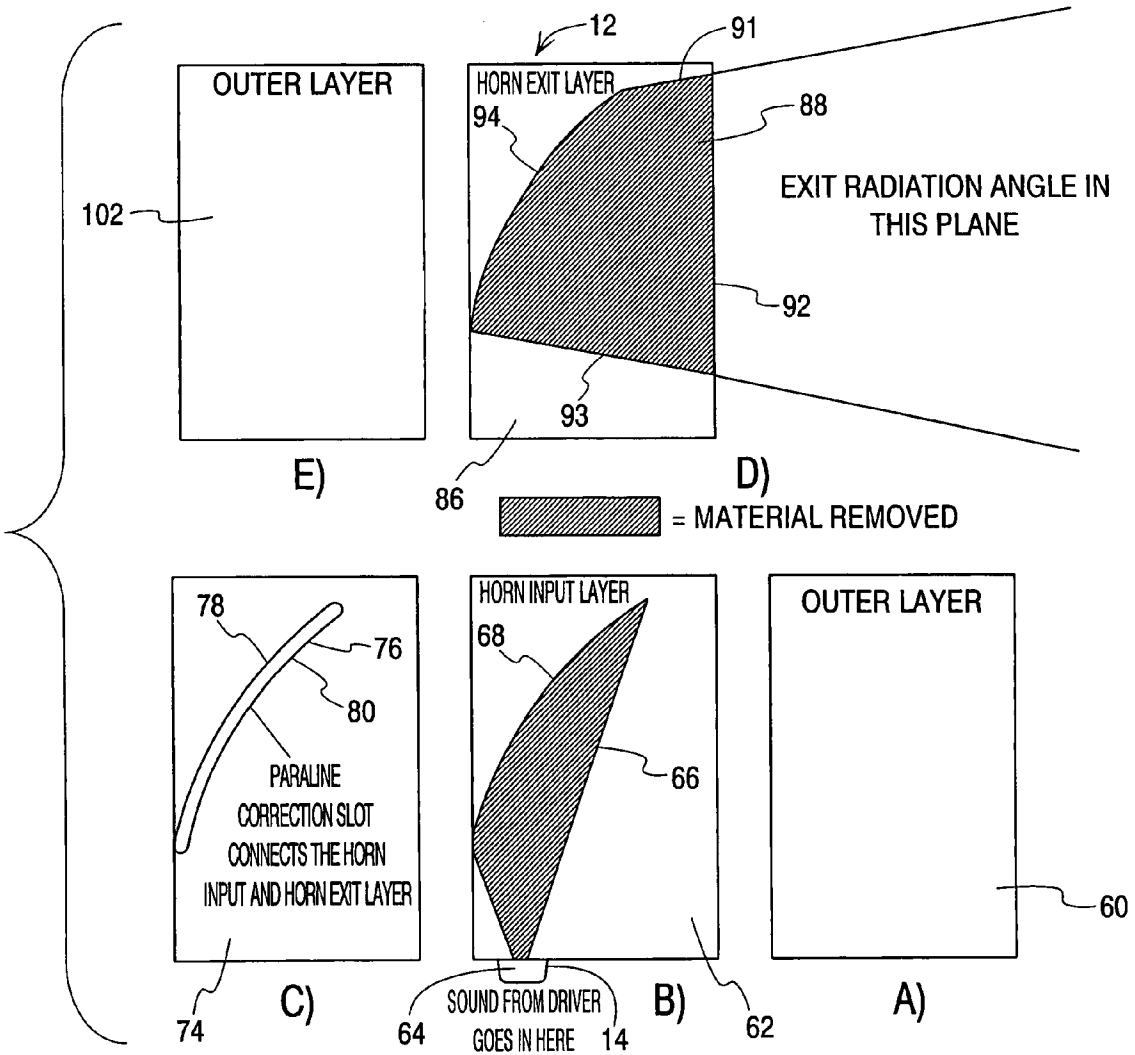
FIGS. 2*a*-2*e* are schematic elevational views of layer components of the first embodiment of a sound reproduction system illustrating certain aspects of the present invention.

Referring now to FIGS. 2(*a*)-2(*e*) elements of a first preferred embodiment of a sound reproduction system 10 according to principles of the present invention are shown. Included are components of an enclosure 12 (see FIG. 1), made from layers of sheet material (a practical construction method). In this version, the angle of the exit radiation is reduced relative to its physical depth. Enclosure 12 may be conveniently constructed by laminating or joining a number of layers together, to form a horn enclosure with a continuous, but changing internal passageway confining the soundwave traveling therethrough. Outer layer 60 is formed according to the external dimensions of the enclosure. Next, horn input layer 62 is formed with an inlet opening 64, and an opening 66 defining a rear wall 68. The next layer, baffle plate 74, includes a slotted opening 76 having a rear reflective wall 78 and an opposed forward wall 80. The horn input layer 62 is placed between layers 60 and 74, such that opening 66 defines input chamber 42 shown in FIG. 15.

Horn exit layer 86 is formed with a cutout opening 88 that includes a mouth or exit opening 92 defined by walls 91, 93 and a curved reflective wall 94. Lastly, outer layer 102 is provided, conforming to the outer dimensions of enclosure 12. Horn exit layer 86 is placed between middle slotted layer 74 and outer layer 102, forming the exit chamber 52. The baffle plate 74 is disposed between horn input layer 62 and horn exit layer 86, such that its slotted opening 76 forms a constriction chamber that is preferably defined in part by the reflective surface of rear wall 78.

FIG. 3 is a cross-sectional view taken along the horizontal mid-section of enclosure 12, as indicated in FIG. 1. FIG. 3 is not drawn to scale, but rather is exaggerated for illustrative purposes. Preferably, the back walls 68, 78, 94 of layers 62, 74 and 86 are all curved with the same curvature, as explained above. These back walls are preferably aligned with one another to form a continuous, curved reflective surface. A small amount of mismatch between the back walls of the internal layers may be acceptable in certain applications.

In one embodiment, the layers of the enclosure are formed from plywood panels having a nominal thickness of about 0.75 inches. The relatively smaller, lateral dimension of slotted opening 76 corresponds roughly to this panel thickness. The openings in other layers are scaled accordingly, as illustrated. Other arrangements are, of course, possible. The layers are preferably securely fastened together to prevent unwanted energy absorption, rattles, noises, etc. If desired, other numbers of layers may be employed Turning now to FIGS. 4-6, a second embodiment of a horn enclosure according to principles of the present invention is generally indicated at 110. Enclosure 110 is shown constructed of 5 layers, although more layers could be employed if desired. Included are outer layers 112, 114, that are generally solid, except for inlet and outlet openings 116, 118. Inlet opening comprises a small diameter central opening for receiving output from a driver, not shown, such as a point source driver of conventional design. Outlet opening 118 comprises a thin vertical slit. A middle baffle layer 122 is slotted with a thin, elongated ovoid or "eye" shaped slot 124. In one example, slot 124 has a width generally corresponding to the thickness of the layer materials employed, although other dimensions can be used, if desired. Slot 124 is comprised of opposed outer and inner surfaces, which, in the illustrated embodiment, have the same curvature, so that the slot 124 is of generally constant width throughout its length. The remaining layers 130, 132 are preferably identical to one another, with internal openings formed by ovoid cut edges 136. The cut edges are shaped and dimensioned such that they are continuous with the outer edge of slot 124 to form a continuous reflective surface therewith, in the manner discussed above.

Figure 5:
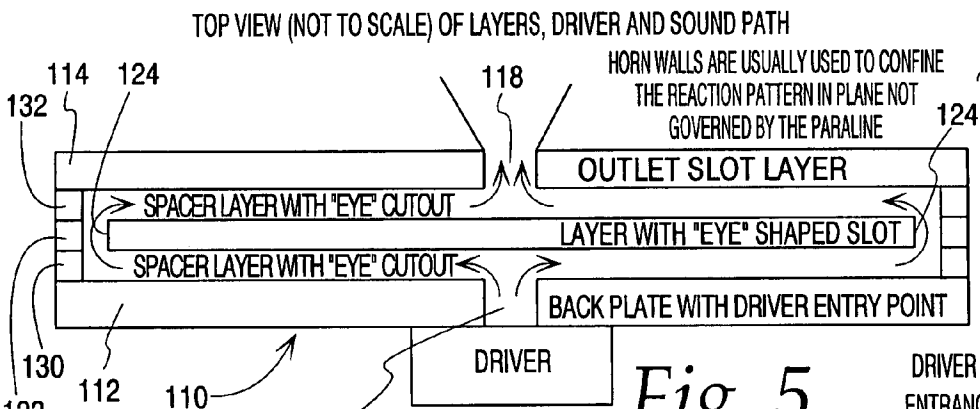
FIG. 5 is a diagrammatic cross-sectional view of the second embodiment of a sound reproduction system illustrating certain aspects of the present invention.

The layers are joined together in the manner indicated in FIG. 5, which also shows a driver 140. As can be seen in the illustrated example, slot 124 has a width corresponding generally to the thickness of the layer 122 from which it is formed, although other relative dimensions can be employed as may be desired.

FIGS. 5 and 6*a* show an inlet chamber formed by layers 112, 130, 122. As indicated in FIG. 6*a*, four path lengths to the reflective surface of slot 124 are shown. FIGS. 5 and 6*b* show an exit chamber formed by layers 122, 132, 114. The continuations of the four path lengths are shown, and it can be seen that, in this preferred embodiment, the sums of the path lengths are equal, to produce a flat wavefront. If desired, other curves can be chosen to produce wavefronts of other shapes.

Figure 4:
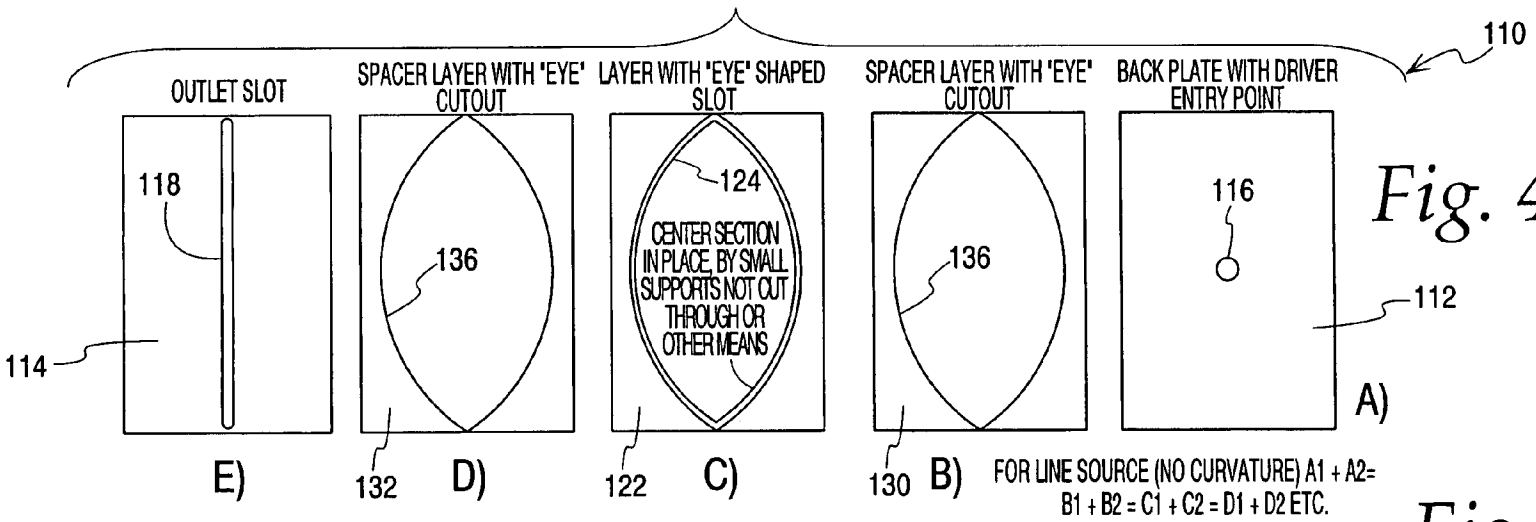
FIGS. 4*a*-4*e* are schematic elevational views of layer components of a second embodiment of a sound reproduction system illustrating certain aspects of the present invention.
Figure 6:
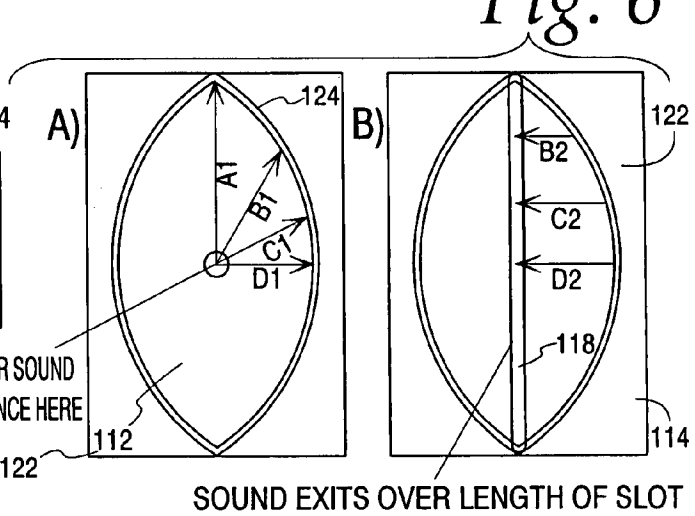
FIGS. 6*a*-6*b* are elevational views taken from each end of the second embodiment of a sound reproduction system illustrating certain aspects of the present invention.
Figure 7:
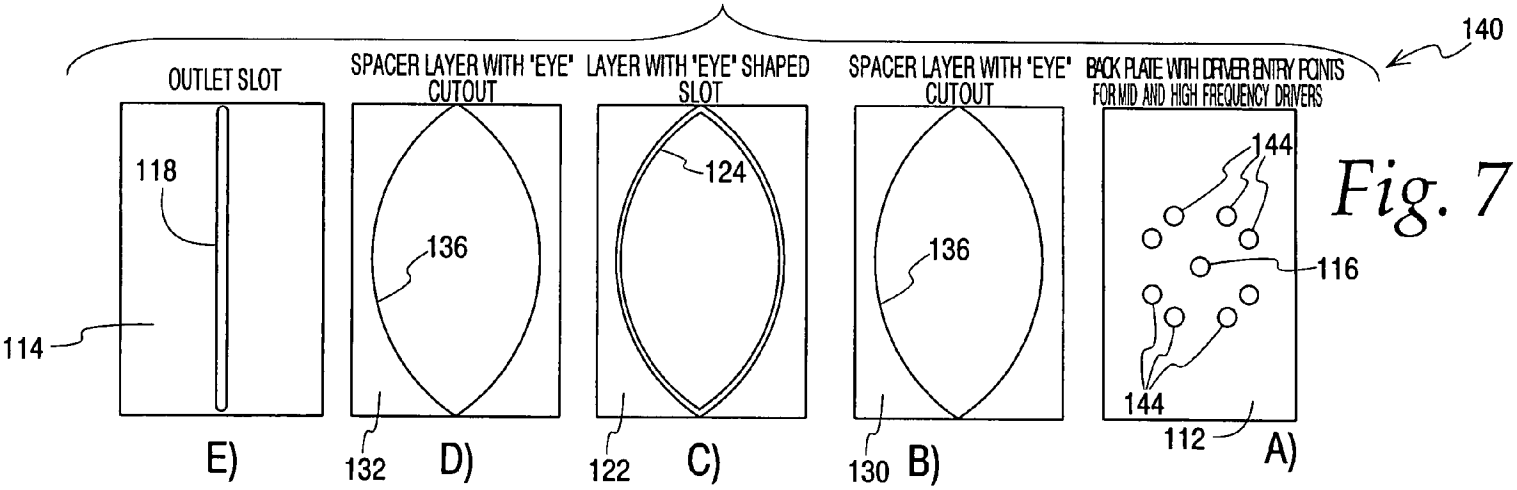
FIGS. 7*a*-7*e* are schematic elevational views of layer components, taken through the horizontal mid-section of a third embodiment of a sound reproduction system illustrating certain aspects of the present invention.
Figure 9:
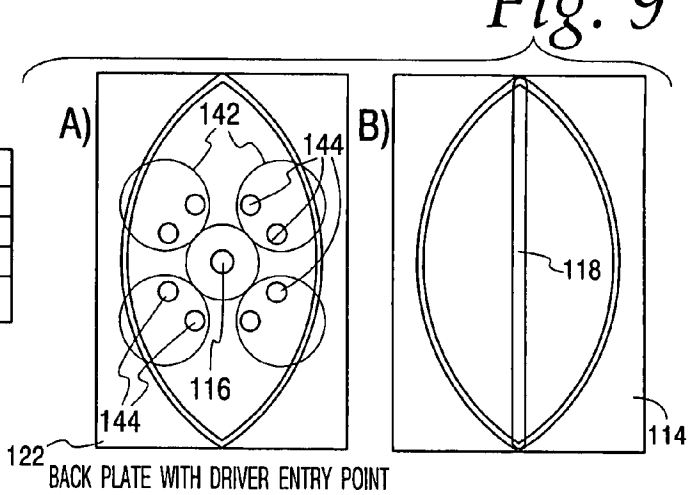
FIGS. 9*a*-9*b* are elevational views taken from each end of the third embodiment of a sound reproduction system illustrating certain aspects of the present invention.
Figure 8:
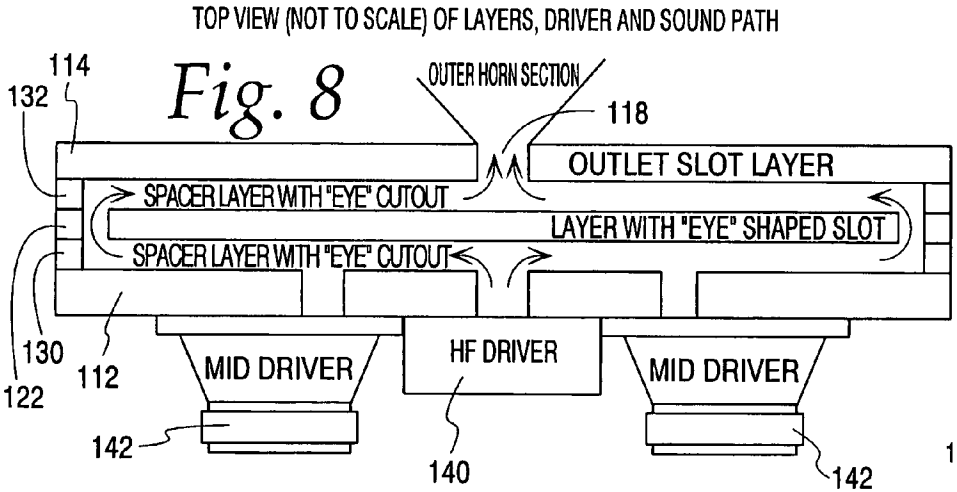
FIG. 8 is a diagrammatic cross-sectional view of the third embodiment of a sound reproduction system illustrating certain aspects of the present invention.

FIGS. 7-9 show an alternative embodiment, based on the embodiment of FIGS. 4-6. The two embodiments are similar, except that the enclosure 140 accommodates mid drivers 142 in addition to the high frequency driver 140. In the preferred embodiment, mid drivers 142 are coupled to an input cavity shown in FIG. 9*a* by inlet ports 144 (see FIG. 9*a*). The input cavity is comprised of the joinder of layers 112, 130, 122 (see FIG. 8). Other features remain the same as the embodiment of FIGS. 4-6. As can be seen in this preferred embodiment, the total path lengths for soundwave components of the high frequency and mid frequency drivers are equal to one another, producing a flat wave front exiting at slot 118.

Figure 10:
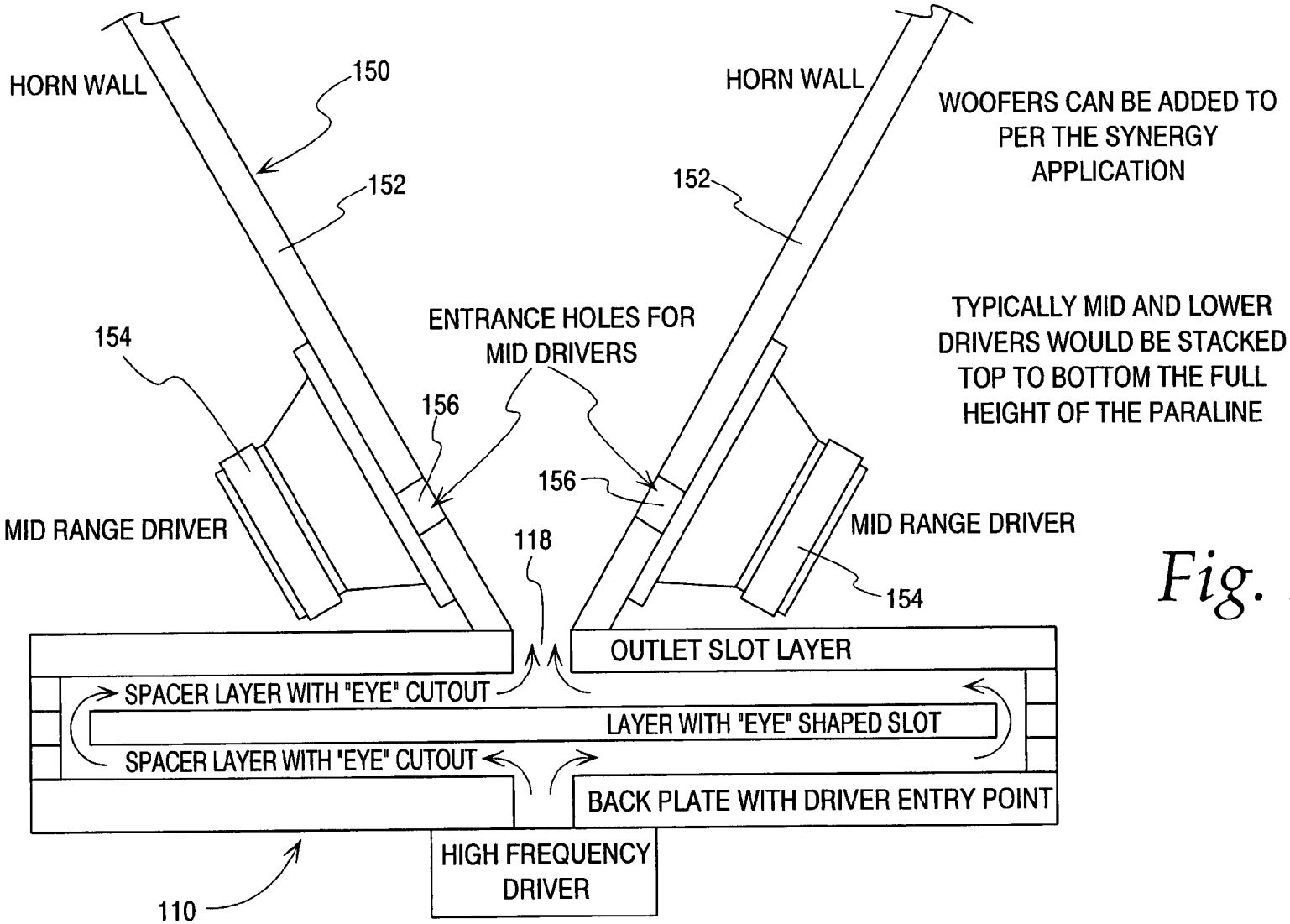
FIG. 10 is a diagrammatic top plan view of a fourth embodiment of a sound reproduction system illustrating certain aspects of the present invention.

FIG. 10 shows an arrangement in which system 110 described above, is followed by a downstream stage generally indicated at 150 that includes horn walls 152. In the illustrated embodiment, mid range drivers 154 have outputs directed into the downstream stage by openings 156, so as to merge with the soundwave exiting system 110 at slot 118.

For those system arrangements that are elongated in a vertical direction, additional mid range drivers may be stacked one on top of another, as space permits. Also, if there is enough room, low frequency drivers can be added alongside drivers 154, and coupled to the downstream stage by their own respective input ports formed in horn walls 152.

Figure 11:
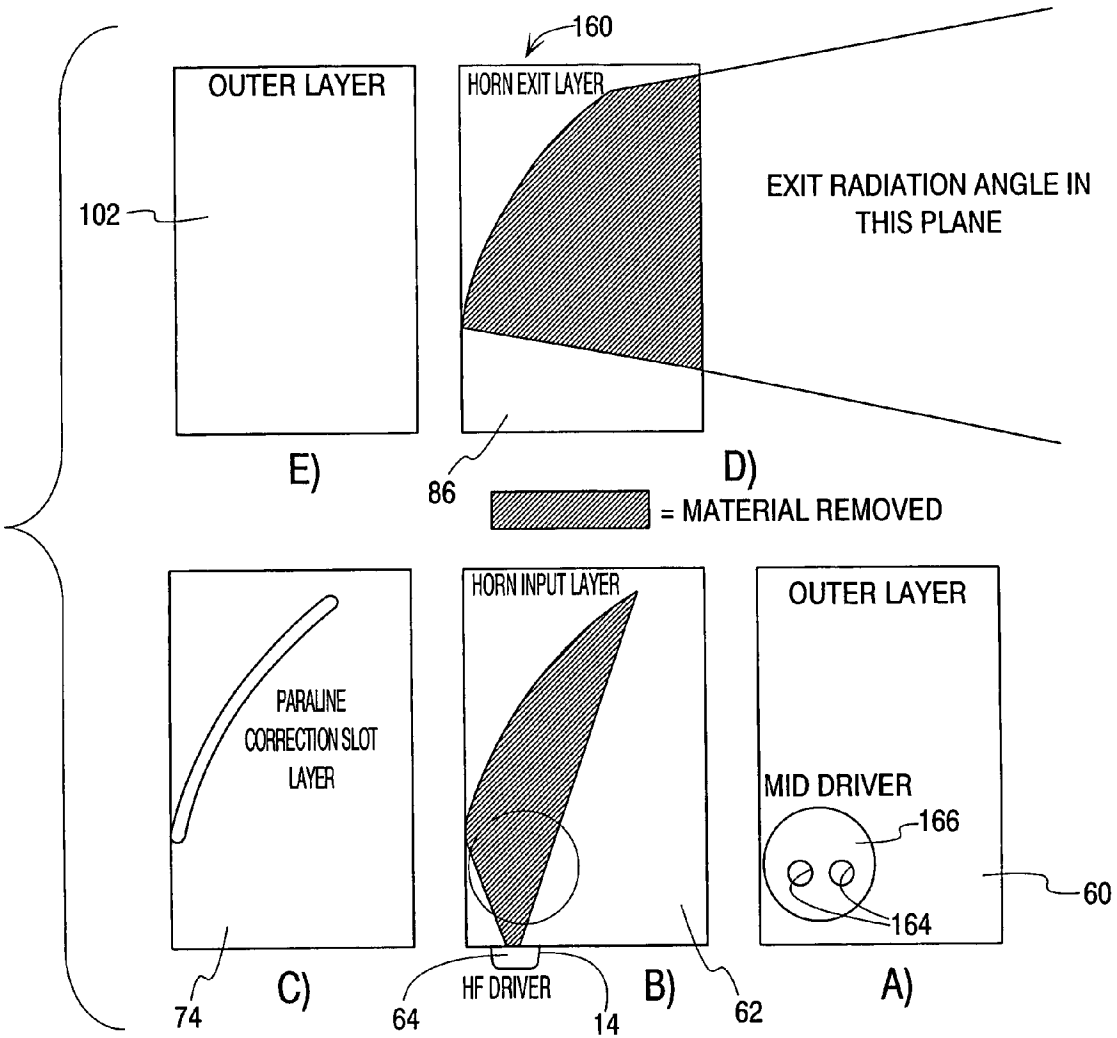
FIGS. 11*a*-11*e* are schematic elevational views of layer components of a fifth embodiment of a sound reproduction system illustrating certain aspects of the present invention.
Figure 12:
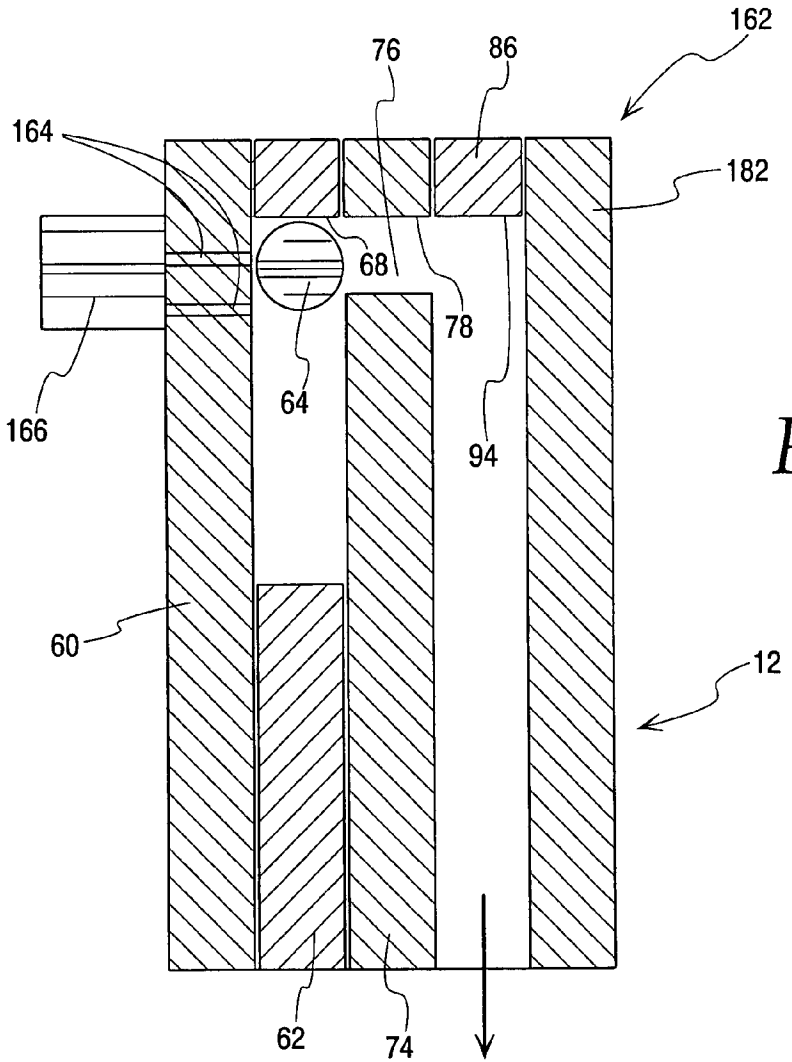
FIG. 12 is a diagrammatic cross-sectional view taken through the horizontal mid-section of the fifth embodiment of a sound reproduction system illustrating certain aspects of the present invention.

Turning now to FIGS. 11 and 12, a further embodiment of a sound reproduction system is shown at 160. The enclosure of system 160 is substantially similar to that of enclosure 12 of FIGS. 2 and 3. Accordingly, the enclosure of system 160 includes outer layers 60, 102, middle layer 74 and intermediate layers 62, 86. The layer 60 of enclosure 162 differs in that it also includes input ports 164 for a mid range driver 166. This allows the soundwave from driver 166 to merge with the soundwave from driver 14, with the combined soundwaves passing through the enclosure, as described above for enclosure 12.

The foregoing description and the accompanying drawings are illustrative of the present invention. Still other variations in arrangements of parts are possible without departing from the spirit and scope of this invention.

I claim:

1. A system for reproducing sound, comprising:

a sound enclosure that defines a soundwave path having a first end, a second open end and at least one bend therebetween;

at least one driver provided at the first end for producing a driver soundwave;

the sound enclosure confining the driver soundwave for travel along the soundwave path; and at least one baffle member situated in the soundwave path, defining a reflective surface of preselected shape that reflects and constricts the soundwave therethrough;

said baffle member further defining a correction slot for a spatially distributed soundwave time delay correction.

2. The system according to claim 1 wherein a bend in the soundwave path is defined by a curved portion of said pathway, located at or near said reflection surface.

3. The system according to claim 1 wherein the at least one driver comprises a point source driver.

* * * * *